United States Patent [19]

Bardeau et al.

[11] 3,985,269

[45] Oct. 12, 1976

[54] AUTOMATIC LIQUID DISPENSING APPARATUS

[76] Inventors: William Milton Bardeau, 33 Harbour Square, Suite 3218, Toronto, Canada, M5J2G2; Frank Welty, 4962 Lockwood Blvd., Youngstown, Ohio 44511

[22] Filed: Aug. 5, 1974

[21] Appl. No.: 494,827

Related U.S. Application Data

[63] Continuation-in-part of Ser. No. 388,948, Aug. 16, 1973, Pat. No. 3,843,020.

[52] U.S. Cl. ..... 222/145; 138/114; 138/37

[51] Int. Cl.[2] ..... B67D 5/60

[58] Field of Search ..... 222/55, 57, 58, 129, 222/129.1, 129.2, 134, 135, 145, 76, 75; 137/408, 606, 607; 138/114, 37, 109; 137/604

[56] References Cited

UNITED STATES PATENTS

| | | | |
|---|---|---|---|
| 2,121,841 | 6/1938 | Tweed | 222/145 |
| 2,379,532 | 7/1945 | Lloyd | 222/129 |
| 2,401,914 | 6/1946 | Di Pietro | 222/145 |
| 2,569,857 | 10/1951 | Jaegle et al. | 137/606 |
| 2,758,553 | 8/1956 | Moser | 222/145 |
| 2,843,150 | 7/1958 | Goodwin | 137/607 |
| 2,986,306 | 5/1961 | Cocovour | 222/129.1 |
| 3,253,326 | 5/1966 | Henry et al. | 138/114 |
| 3,359,996 | 12/1967 | Cornelius | 222/145 |
| 3,843,020 | 10/1974 | Bardeau et al. | 222/58 |

FOREIGN PATENTS OR APPLICATIONS

| | | | |
|---|---|---|---|
| 1,264,907 | 2/1962 | United Kingdom | 137/604 |

*Primary Examiner*—Stanley H. Tollberg
*Assistant Examiner*—H. Grant Skaggs

[57] ABSTRACT

This invention relates to apparatus for automatically dispensing a two component liquid system such as a beverage; particularly, for delivering two liquid components to a mixing station by means of concentric tubular sections at or near the discharge end with the inner tubular section provided with a discharge orifice intersecting with the surrounding flow path located between the inner and outer tubular sections; providing for a downstream discharge section of sufficient capacity to pass the mixture without pressure build-up; controlling the fluid flow by providing valves in the several conduit sections operable in sequence; storing at least one liquid component upon a resilient platform responsive to the increment of change in the load of liquid as it is depleted such that the liquid level is maintained thereby establishing a substantially constant head of the one liquid for the system.

16 Claims, 14 Drawing Figures

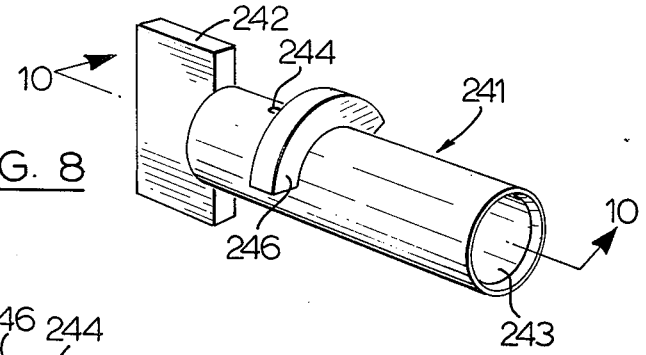
FIG. 8
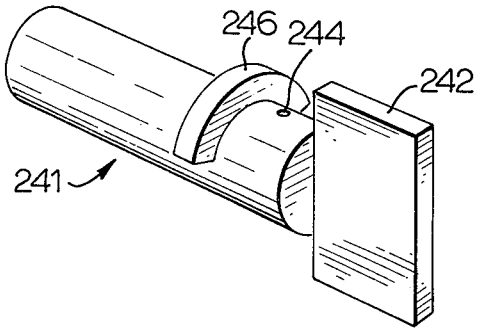
FIG. 9
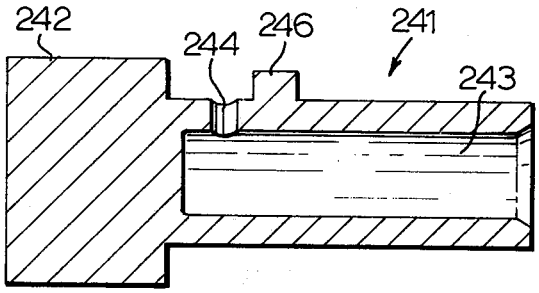
FIG. 10
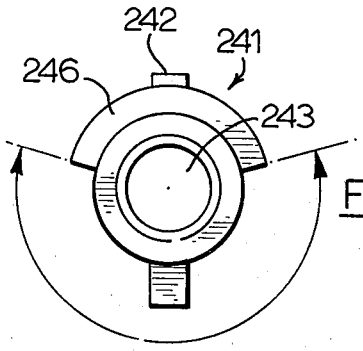
FIG. 11
FIG. 12
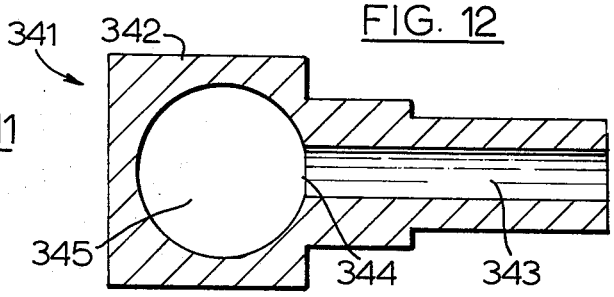

AUTOMATIC LIQUID DISPENSING APPARATUS

This application is a continuation-in-part of our application filed Aug. 16, 1973 under Ser. No. 388,948, now issued under U.S. Pat. No. 3,843,020 on Oct 22, 1974.

BACKGROUND TO THE INVENTION

Many beverages are provided for commercial dispensing in the form of a flavoured liquid concentrate and a diluent such as water or a carbonated liquid with the components to be delivered under pressure in selected proportions for mixing at the dispensing spout or discharged separately into a vessel wherein the components are blended together.

In the case of coffee, particularly, traditionally it has been brewed for commercial consumption in facilities utilizing ground coffee deposited in filters through which selected quantities of heated or boiling water are slowly passed whereupon the brewed batches are stored in vessels or in urns to be dispensed from time to time upon demand.

Variations in the character and quality of the product are to be expected because of the handling involved including the measuring out of quantities by the operator and because of problems presented by storage. Further, if brewed coffee must be stored for long periods at elevated temperatures, it tends to lose its freshness and flavour.

Liquid coffee concentrates derived from large commercial brewing facilities have been available and such concentrates can be supplied in packaged units of specified weight or in bulk for reconstitution into a potable beverage by the addition of hot water, provided the concentrate is properly stored at low temperatures, through automatic dispensing equipment.

Many difficulties however have been encountered with such equipment particularly in obtaining a dispensed mixture which is consistently uniform in the proportions of solute to diluent.

THE NATURE OF THE INVENTION

This invention relates to improvements in such apparatus for automatically dispensing upon demand a liquid derived from two liquid components stored separately and brought together for mixing prior to discharge from such apparatus. More particularly this invention relates to apparatus for supplying a solute such as liquid coffee concentrate and a diluent such as hot water and automatically dispensing on demand a composite beverage consistently uniform in proportions of concentrate to diluent.

OBJECTS OF THE INVENTION

One very important object of this invention is to provide apparatus wherein two liquid components of a system, a solute and a diluent can be successfully separately supplied under optimum conditions for delivery to a mixing station, in selected proportions by volume, continuously or at intervals and automatically upon demand to yield a product for example, a beverage, that is uniform as to taste and flavour at optimum temperatures.

More particularly it is an object of this invention to provide apparatus for storing and automatically dispensing a beverage derived from two liquid components wherein the character and quality of the beverage dispensed is of a high order and is preserved whether a small volume or a large volume is withdrawn or whether the apparatus has been idle or in continuous operation.

Another important object is to provide apparatus of the character described wherein the two components of the liquid system are thoroughly mixed before they are discharged from the faucet spout to achieve uniformity of taste and appearance.

Another important object is to provide apparatus of the type described, wherein the proportions of the solute to diluent can be altered as desired or as circumstances would dictate.

Still another important object is to provide storage facilities and a dispensing conduit system for such apparatus in which the structures, components and mode of operation are simplified, all of which are readily accessible for inspection, repair or for cleaning, easily taken apart and reassembled and in which complex instrumentation is avoided thereby reducing manufacturing and maintenance costs and also directly increasing the efficiency of operation.

FEATURES OF THE INVENTION

On feature of this invention resides in providing, in apparatus for automatically dispensing liquid derived from two liquid components to be delivered separately from their sources to a confluence or mixing station downstream, the combination of a first larger conduit section terminating downstream in a discharge orifice and adapted for connection upstream with one liquid source, and a second smaller conduit section supported within the first larger conduit section and in spaced relation thereto to define a surrounding passageway therewith in the region between the discharge orifice and upstream connection of the first larger conduit section, the second smaller conduit section being adapted for connection upstream to the other liquid source and terminating downstream in an orifice defining a flow path intersecting with the flow path defined by the surrounding passageway, with the bores and discharge orifices of the larger and smaller conduit sections being selected to pass a given volume of liquid diluent and liquid solute, respectively, under selected conditions of the system to thereby provide a liquid or beverage of desired characteristics.

More particularly it is a feature of this invention to construct the smaller conduit section in two parts, a downstream portion and an upstream portion with the downstream portion having the discharge orifice therein and being removably separable from from the upstream portion, whereby by substituting one downstream portion for another having a discharge orifice therein of lesser or greater diameter the proportions of diluent to solute can be altered.

Still another feature resides in providing apparatus of the character described wherein the removably separable downstream portion is provided with a fin formation adapted to cooperate with a socket formation presented by the surrounding first larger conduit section for releasably locating the downstream portion of the smaller conduit section in a fixed relation to the upstream portion thereof and also in fixed relation and to the surrounding larger conduit section and to lock the parts against separation.

Particularly it is a feature of this invention to utilize the fin and socket formation to locate the discharge orifice of the smaller conduit section so that it may project upwardly whereby when fluid flow is frequently interrupted the more concentrated solution will be held within the smaller conduit section and the tendency to migrate minimized In the case where large quantities of mixed liquids are to be drawn over an extended period, an axially located downstream orifice is provided to continuously meter and deliver the solute into the confluence or mixing station prior to being dispensed.

Another feature resides in providing a discharge section terminating in a discharge orifice downstream of the mixing station and of a cross-section throughout sufficient to pass the combined flow of solute and diluent without impressing a pressure build-up that would alter the established ratio of components.

Still another feature of the invention resides in providing a valve for interrupting the flow of fluid in the downstream discharge section beyond the mixing station, and a valve upstream in the conduit of the system delivering a liquid component to its respective conduit section, each latter valve operable to interrupt the flow of liquid, and providing an interconnection between the valves including a cam and cam follower whereby upon operation of the first mentioned valve to open there is a delay in the opening of the two latter mentioned valves and upon movement of the first mentioned valve to close, the closing of the two latter mentioned valves precedes the full closing of the first mentioned valve whereby that portion of the system at the confluence or mixing station can be drained and further whereby any effect upon the system by the first mentioned valve in limiting the cross section of the discharge orifice and so impede fluid flow is minimized.

Still another feature resides in providing apparatus wherein pumping devices are eliminated and the character of fluid flow determined by gravitational forces and atmospheric pressure by providing in combination a first stationary vessel for storing one liquid component open to the atmosphere with a supply conduit in fluid communication therewith to supply liquid from a source under pressure and with a suitable control device for controlling the supply of such liquid to the stationary vessel to maintain a substantially constant level of liquid therein, together with a resilient support formation carried by the apparatus in spaced relation to the stationary vessel which resilient support formation is extensible substantially uniformly incrementially in a vertical direction in direct proportion to an increment of change in a selected applied load, which in accordance with the invention is in the form of a displaceable vessel to hold a measured volume of the second liquid component, in a manner whereby the level established by the measured volume of the second liquid component within its vessel is maintained by the resilient support formation by displacement of the vessel as the second liquid component is depleted under gravitational force and atmospheric pressure, the two liquid components so stored within the apparatus being provided with separable conduits leading to a confluence or mixing station downstream and located below the liquid levels maintained in the two vessels.

THE DRAWINGS OF THE DESCRIPTION

These and other objects and features are outlined in greater detail in the following description to be read in conjunction with the sheets of drawings in which, FIG. 1 is a perspective view of apparatus embodying the invention taken from a point forwardly of such apparatus in front elevation and upwardly to the right, with sections of the apparatus shown partly exploded and partly broken away;

FIG. 8 is a perspective view of the modified cap formation adapted to alter the characteristics of fluid flow, taken from a point upstream and to the rear of such cap formation;

FIG. 9 is a perspective view of the modified cap formation of FIG. 8 taken from a point to the left and upwardly and downstream from such cap formation as viewed in FIG. 8;

FIG. 10 is a vertical cross-sectional view of the modified cap formation of FIGS. 8 and 9 taken along the lines 10 — 10 of FIG. 8;

FIG. 11 is a rear elevational view of the cap formation of FIGS. 8, 9 and 10;

FIG. 12 is view in vertical cross section of still another modified cap formation adapted to further alter the characteristics of fluid flow.

Figure 1:
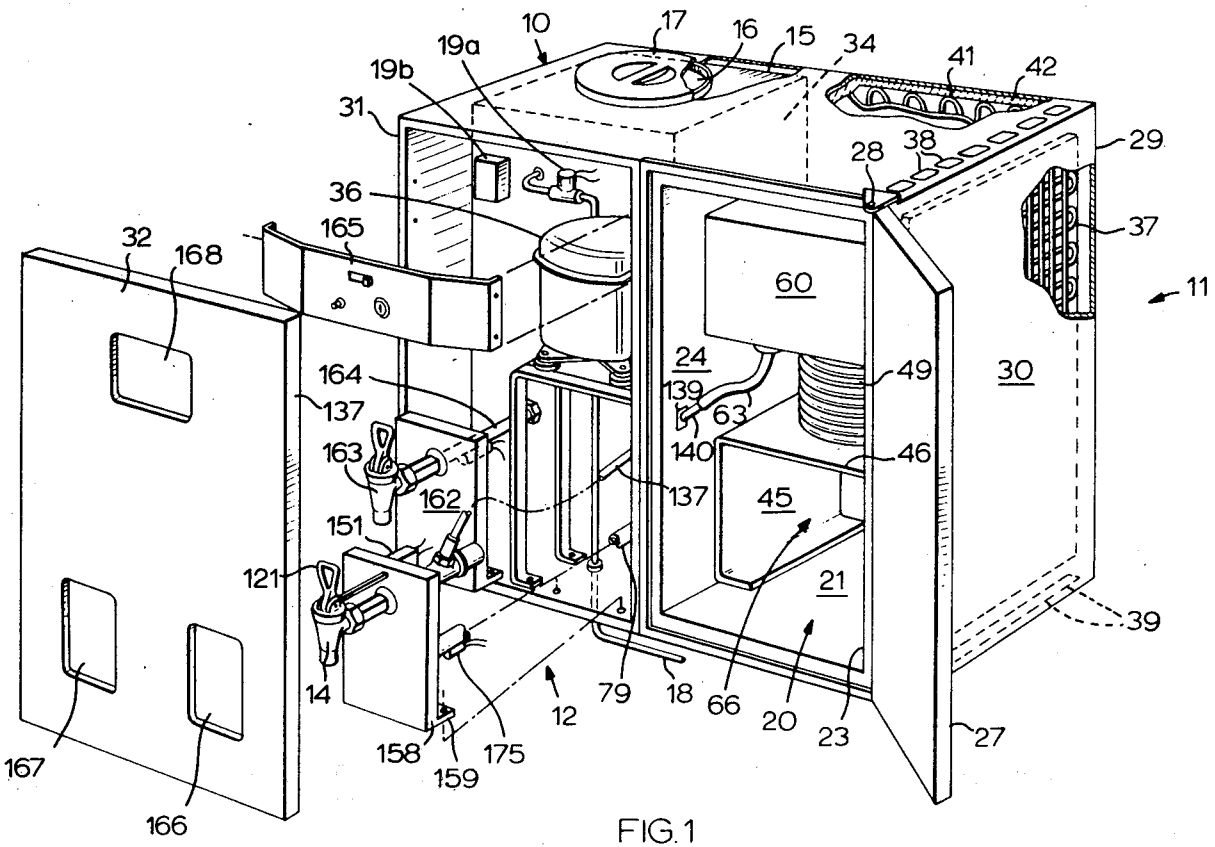

The preferred embodiment of the invention illustrated in FIG. 1 is intended to be used in the automatic dispensing of coffee derived from liquid coffee concentrate supplied in a packaged unit and to be kept sealed against penetration by the atmosphere and a source of hot water.

The character and quality of the liquid coffee concentrate is preserved by isolating it from the atmosphere and by refrigeration at a temperature between above freezing and below 40°F and preferably in the range of between 33°F and 37°F.

In order to provide coffee for consumption, water for mixing with the concentrate must be supplied at temperatures very near but below the boiling point of the order of 206°F upwardly.

THE STORAGE FACILITIES FOR THE LIQUID DILUENT AND THE LIQUID SOLUTE

The preferred embodiments of the invention illustrated in the drawings with reference particularly to FIGS. 1, 2A, 2B, 3, 4 and 5 includes a first storage for the liquid diluent indicated generally by the arrow 10, a second storage for the liquid solute indicated generally by the arrow 11 and a conduit system indicated generally at 12 for delivering separately the respective stored liquids to a confluence or mixing station 13 before discharge through a dispensing faucet 14.

The first liquid storage 10 for the diluent comprises a vessel 15 having a rectilinear configuration, constructed preferably from stainless steel sheeting and is located within and securely supported by the enclosing framework of the apparatus and fastened or welded thereto.

The upper open end 16 of the vessel 15 is closed by a removable cover 17 to facilitate venting; inspection, repair and cleaning.

In accordance with the preferred embodiment illustrating the nature of the invention, water is to be supplied to vessel 15 from the distribution system of a municipality under normal pressure through a suitable inlet conduit 18 in which, preferably, a solenoid operated control valve **19*a* is located, the latter valve being responsible to a level controller 19*b* which is adapted to sense and maintain a selected water level in vessel 15 upon energization of a suitable electrical circuit initiated by level controller 19*b* to admit water to vessel 15 sufficient to restore the selected level whereupon level controller 19*b*** acts to disconnect the power from the circuit all in a manner well known in the field.

In accordance with the preferred embodiment the water admitted to vessel 15 is to be heated through suitable thermostatically controlled resistance elements not illustrated mounted to extend within vessel 22 of such capacity and in such pattern as may be necessary to generate heat to maintain the volume of water in vessel 15 at a selected temperature, for example at approximately 206°F or higher but below boiling by means of a thermostatic switch control.

Preferably the hardness of the water supplied will be removed by suitable ion-exchange apparatus, not illustrated, installed in a well known manner in the aforementioned inlet conduit 18 for vessel 15.

The storage facility 11 for the solute comprises a compartment 20 bounded by wall sections including bottom wall 21, top wall 22, side walls 23, 24 and rear wall 25, all made preferably from sections of suitable stainless steel sheeting.

The opening 26 to compartment 20 is provided with a closure 27 hinged as at 28 to swing from an open position shown in FIG. 1 to a fully closed position to seal compartment 20 from the atmosphere.

An outer casing 29 is employed to enclose and conceal the internal structures and systems and includes side panels 30, 31, front panel 32, rear panel 33 and top and bottom panels 34, 35 respectively, preferably made from sections of suitable stainless steel sheeting and secured by welding or by fasteners to the inner wall sections and to the supporting framework.

Compartment 20 and closure 27 are insulated to inhibit heat transfer by providing layers of suitable insulation sandwiched between the inner wall sections and outer wall panels.

Figure 2B:
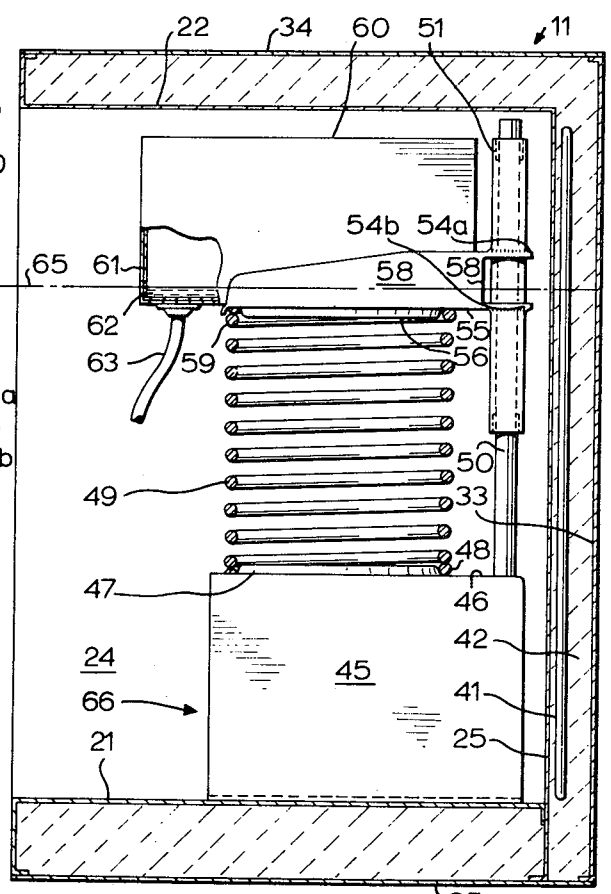
FIG. 2B is a view similar to FIG. 2A but illustrating another position assumed by the displaceable structure established during the operation.
Figure 2A:
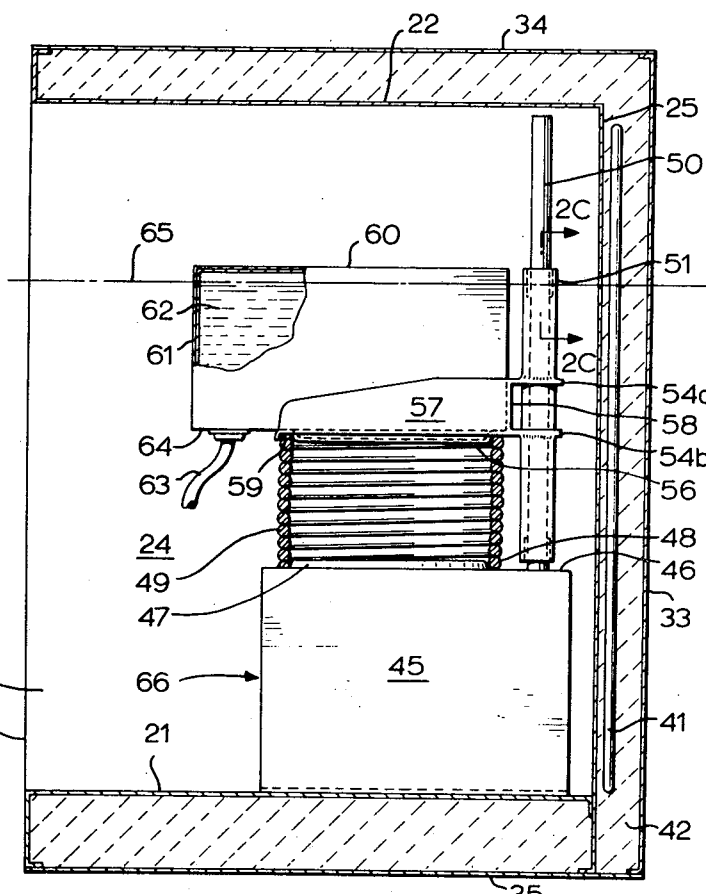
FIG. 2A is a side elevational view in vertical cross section of the apparatus of FIG. 1 taken along the lines 2A—2A of FIG. 1 to reveal the internal structure of the storage facility for the solute in the system and one of the positions assumed by the displaceable structure during the operation.
Figure 6:
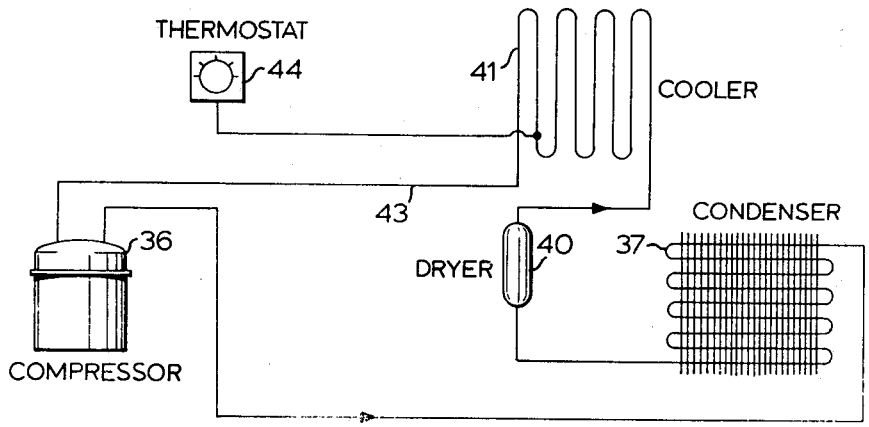
FIG. 6 is a schematic diagram depicting a refrigeration system installed in the preferred embodiment of the apparatus illustrated in FIG. 1.
Figure 7:
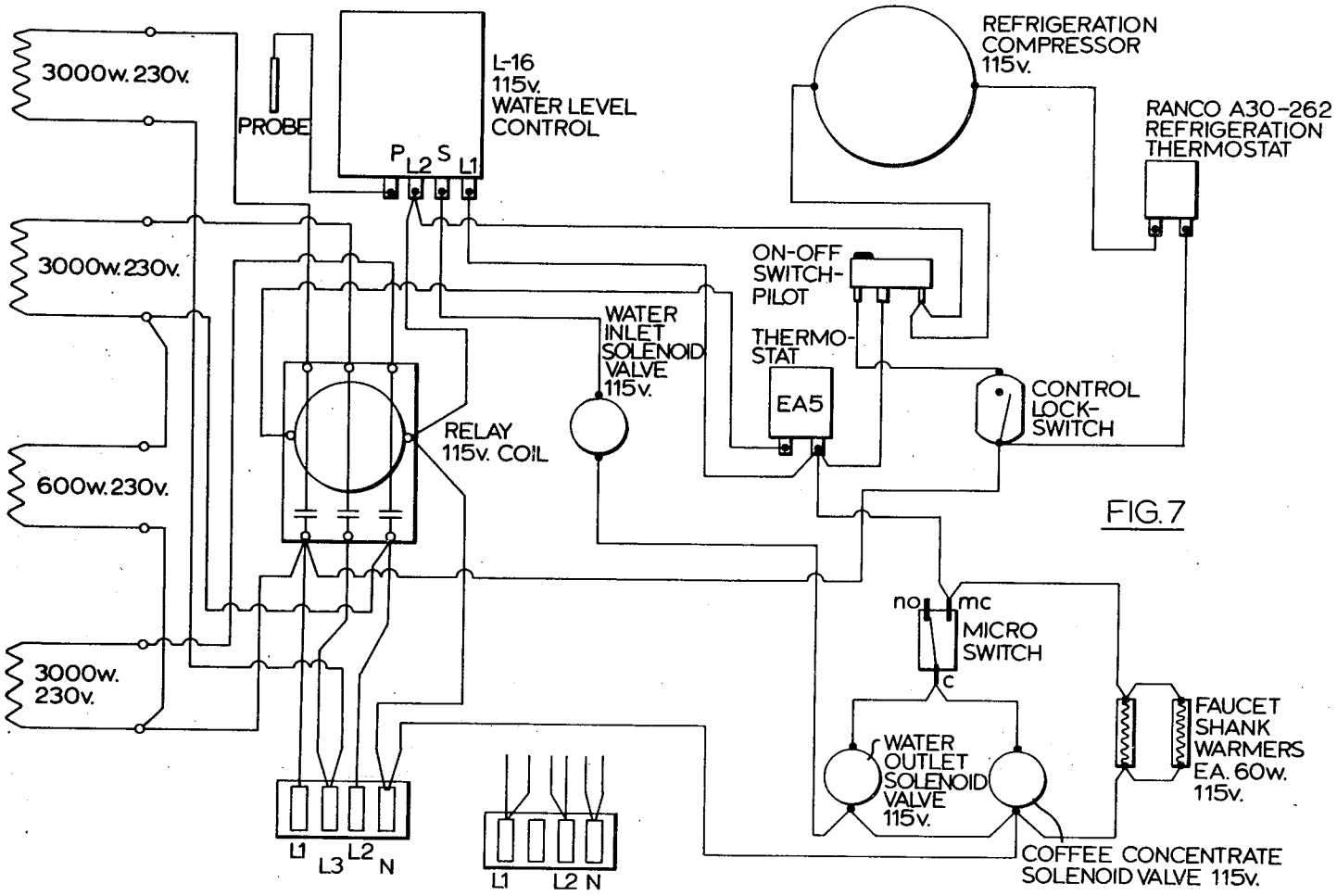
FIG. 7 is a schematic wiring diagram for the electrical system used in providing electrical power for the apparatus illustrated in FIG. 1.

In the preferred embodiment compartment 20 is adapted to be refrigerated by a closed circuit vapour compression refrigeration system, certain components of which appear in FIGS. 1 and 2A and 2B of the drawings, with the system being illustrated schematically in FIG. 6 of the drawings.

A motor driven compressor 36 adapted to be operated by a suitable electrical power supply, is located in series with a condenser 37 mounted to extend vertically and housed between outer side wall panel 30 and inner side wall section 23 of compartment 20, with the insulation layer therefor located inwardly thereof against the inner side wall 23.

Top and bottom wall panels 34 and 35 of outer casing 29 are provided with a series of spaced slots 38, 39 respectively, to provide communication with the atmosphere for the housed condenser 37 to accommodate circulation of air to pass upwardly from below through slots 39 for contact with the heat transfer surfaces of condenser 37 and then discharged upwardly through slots 38 under convection.

The refrigeration system is provided with the usual dryer 40 containing a suitable drying agent for absorbing moisture as may have penetrated the system, which dryer is located between condenser 37 and the evaporator 41.

Evaporator 41 is mounted to extend vertically in closely spaced relation to the rear wall section 25 of compartment 20 with the layer of insulation 42 for that wall section being arranged outwardly of evaporator 41 as best seen in FIGS. 2A and 2B, whereby abstraction of heat from the environment of compartment 20 through the stainless steel rear wall 25 for absorption by the refrigerant in the evaporator 41 may be readily accomplished.

Conduit 43 leading from evaporator 41 to compressor 36 completes the circuit.

The refrigeration system is controlled in the usual manner by a suitable thermostat 44 measuring the temperature of compartment 20 and located in the electrical circuit for providing power to the motor driven compressor 36.

Mounted to extend above bottom wall 21 of compartment 20 as best seen in FIGS. 2A and 2B is a channel shaped shelf formation 45 presenting an upper generally horizontal platform 46 stamped centrally to present a raised circular boss formation 47 to locate the lowermost coil 48 of a resilient spring formation 49 centrally forwardly upon platform 46 as illustrated in FIGS. 2A and 2B.

Lowermost coil 48 is spot welded in position surrounding the raised circular boss formation 47 to anchor the resilient spring formation 49 against displacement.

The rear portion of shelf formation 44 is spaced from the rear wall 25 of compartment 20 whereby an uninterrupted surface may be utilized for heat transfer as well as to facilitate cleaning of the compartment should that be necessary.

Located next adjacent the rearward edge of shelf formation 44 to extend vertically upwardly therefrom is a rigid column 50 of circular cross section and preferably of stainless steel polished to a smooth mirror finish.

The base of the column 50 is securely anchored to shelf formation 45 as by welding.

Figure 2C:
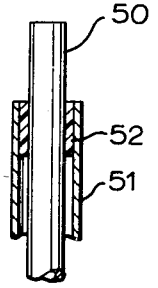
FIG. 2C is an enlarged view broken away of the support and guiding formation included in the structure illustrated in FIGS. 2A and 2B, taken along the lines 2C—2C of FIG. 2A.

As best seen in FIG. 2C a metal sleeve 51 of stainless steel is fitted with suitable bushings 52 at each end for close siding movement vertically along column 50, the selected bushings having the ability to slide freely and smoothly at low temperatures in the range of 32°F to 38°F.

A preferred material for the bushings is an FBA approved plastic in contact with brass.

Metal sleeve 51 is supported from a horizontal tray formation 54 by a pair of spaced lugs 54*a*, 54*b* apertured centrally to receive the sleeve 51 therewithin and is welded thereto.

The arrangement of tray formation 54 together with sleeve 51, lugs 54*a*, 54*b* slidable vertically upon column 50 is intended to provide support and to guide tray formation 54 under displacement by the resilient spring formation 49.

Horizontal tray formation 54 has a bottom wall 55 presenting a centrally located depending circular boss formation 56 corresponding to the lower circular boss formation 47. Upstanding peripherally at each side of tray formation 54 are side walls 57 and at the rear wall 58.

The contour and dimensions of tray formation 54 have been selected such that the depending circular boss formation 56 will be located in vertical alignment with the circular boss formation 47 presented by platform 45 therebelow, and so that the uppermost coil 59 of resilient spring formation 49 will closely surround the depending circular boss formation 56 and can be spot welded thereto.

In accordance with the preferred embodiment resilient spring formation 49 is calibrated to provide a gain rate in pounds per inch against a selected applied load.

A typical spring according to the preferred embodiment will have a gain rate of four pounds per inch and a mean diameter of approximately seven inches whose coils are drawn from 5/16 inch series, and includes 10 coils in all with eight active coils.

The resilient spring formation 49 is preloaded so that under the selected maximum load there will be residual resistance to compression in the active coils.

In FIGS. 2A and 2B a disposable carton 60 for packaging a measured volume of liquid solute is illustrated and includes an outer corrugated cardboard casing 61 in which a thin walled sack or bag 62 of suitable plastic is located, the sack 62 having an inlet-outlet plastic tube 63 which tube penetrates lower outer cardboard wall 64 of carton 60.

The combination of the cardboard casing 61 and inner plastic sack 62 possess sufficient strength to contain and support a substantial quantity of liquid concentrate. Moreover, the carton can be readily filled with the concentrate and then sealed off from the atmosphere for storage either by clamping tube 63 or by heat sealing the tube wall in a manner well known in the field.

The selected applied maximum load for the resilient spring formation 49 in the preferred embodiment is in the order of 20 lbs. ± 1 ounce.

A full carton 60 placed upon tray formation 54 will be located by side walls 57 and rear wall 59 over the resilient spring formation as illustrated in FIGS. 2A and 2B.

The selected applied maximum load of 20 lbs. compresses the resilient spring formation 49 having a gain rate of 4 lbs./in., approximately a distance of 5 inches to establish a liquid level for the concentrate at an elevation indicated at 65.

As liquid coffee concentrate is withdrawn from the sack 62 through tube 63 under gravity and under atmospheric pressure the load decreases proportionately and because the resilient spring formation 49 is calibrated to exert a gain rate of 4 lbs./in., it will react to extend upwardly correspondingly incrementially to elevate the carton 60 to maintain the liquid level at 65.

The effect is visually demonstrated by the view illustrated in FIGS. 2A and 2B.

The thin plastic material constituting the sack 62 will collapse under atmospheric pressure thereby avoiding any vacuum lock in the system and maintaining the isolation of the contents from the atmosphere.

Accordingly, by establishing a liquid level of concentrate at an elevation above a discharge orifice in order to utilize gravity feed, by selecting an applied load which will be subjected to atmospheric pressure and by calibrating a supporting resilient spring formation, gravity and atmospheric pressure can be employed to empty the contents of a displaceable vessel, which conditions being reproducible are a factor used to control the flow rate of the concentrate and hence the flow rate of the dispersed composite liquid.

Lifewise, by maintaining the water of vessel 15 at a constant level at atmospheric pressure and using gravity feed conditions are established which are reproducible for controlling the flow rate of the water and hence the flow rate of the composite liquid.

It will be noted that in FIGS. 1, 2A and 2B that the platform 46 of channel shaped shelf formation 45 is spaced well above bottom wall 21 of compartment 20 to define a recess 66 designed to store a second carton of liquid coffee concentrate, thereby ensuring that an adequate supply will be readily available.

It will be understood that in place of the packaged concentrate a stainless steel vessel could be mounted on the platform 46 and such vessel filled from a large bulk storage, or other suitable alternative adopted, without departing from the principle embodied on the structure described.

THE CONDUIT SYSTEM

Figure 3:
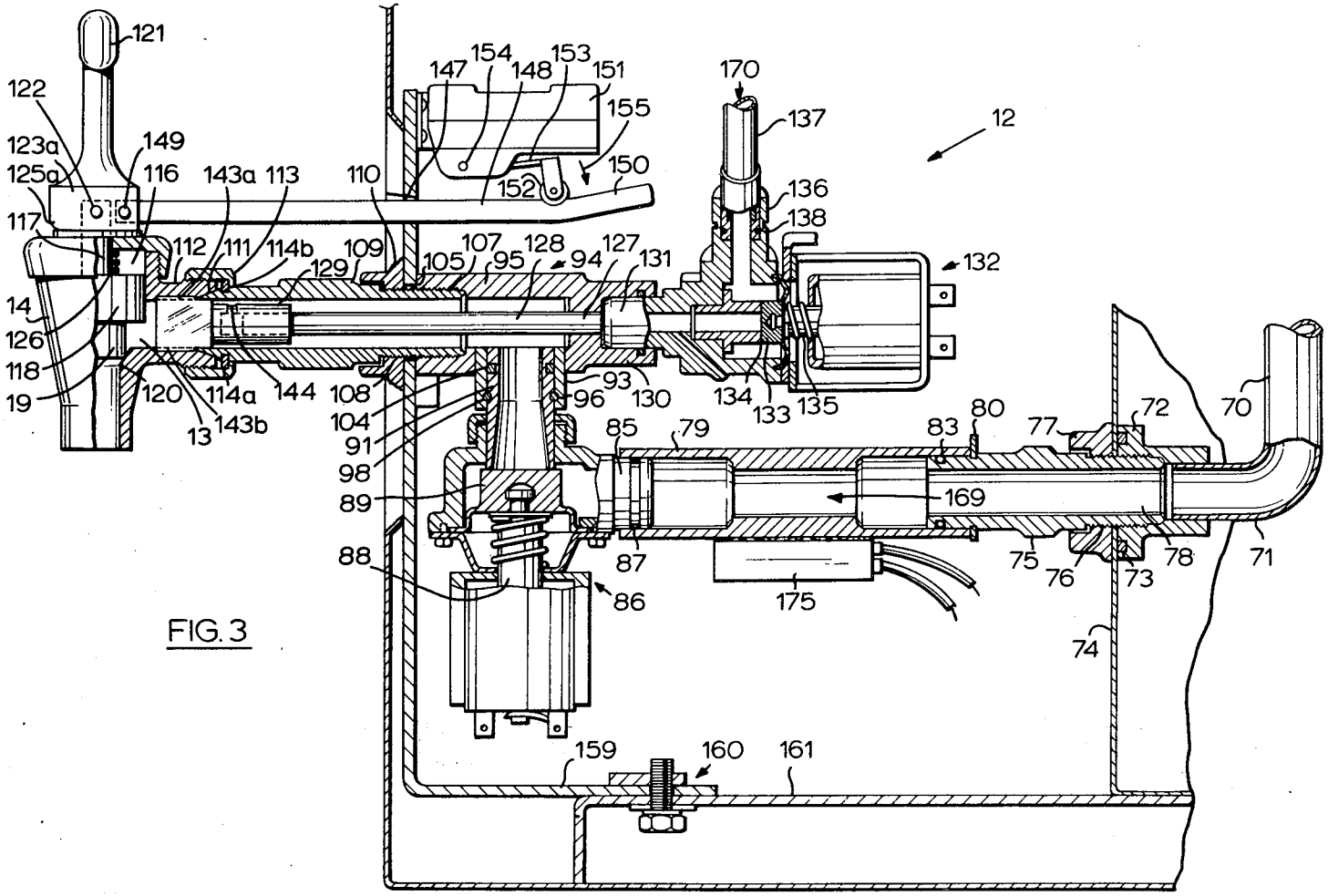
FIG. 3 is an enlarged view in vertical cross section of the conduit system of the apparatus of FIG. 1.
Figure 5:
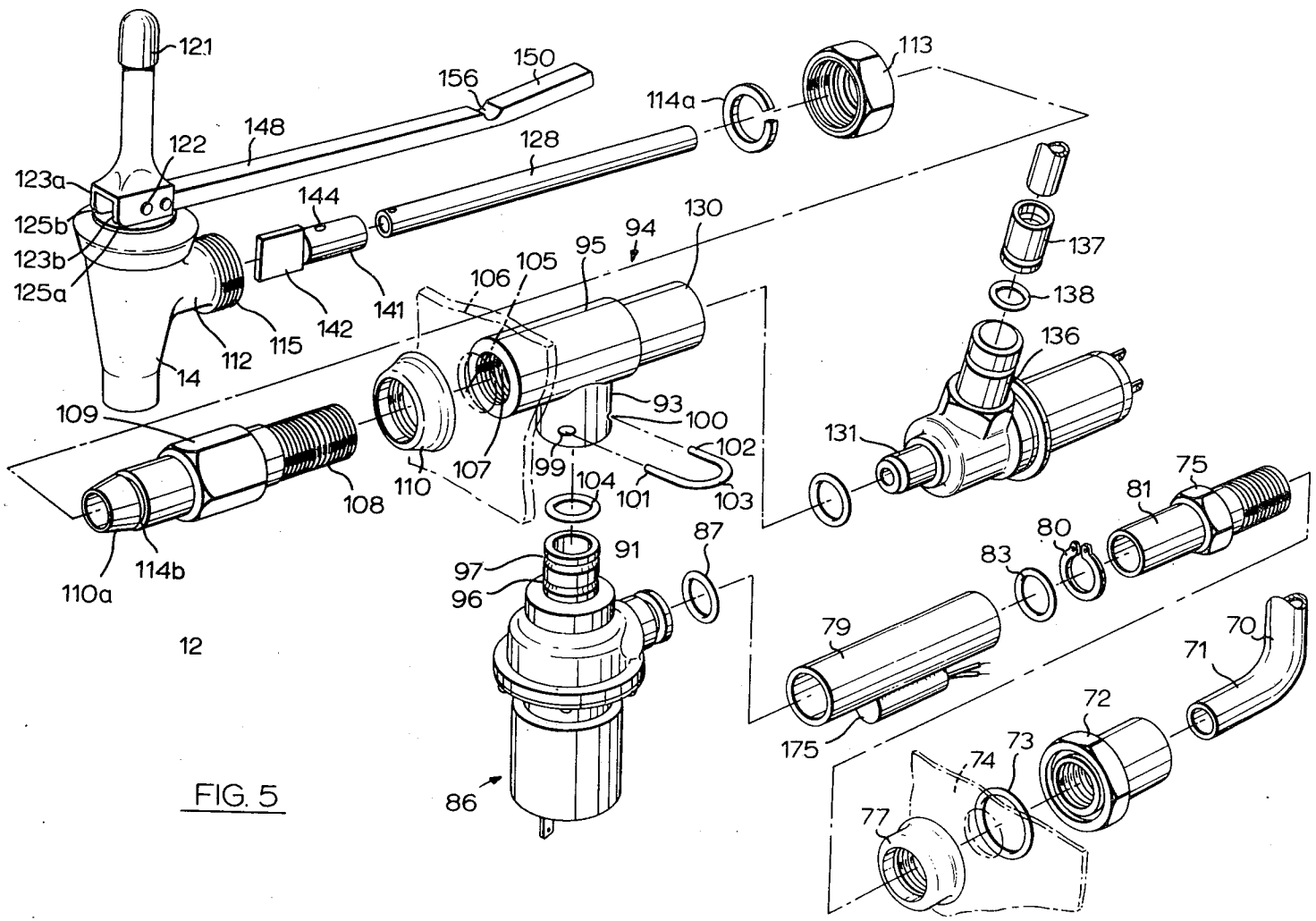
FIG. 5 is an enlarged perspective view of the conduit system of FIG. 1 with the parts thereof exploded to illustrate their manner of interengagement.

As best seen in FIGS. 3 and 5 water heated in stationary vessel 15 for delivery to the mixing station 13 at the inlet of dispensing faucet 14 is to be taken from the upper region of vessel 15 below the established level, by mounting a conduit section 70 to extend vertically upwardly within vessel 15, open at the top and terminating below in an elbow portion 71 swaged within the upstream end of a tubular coupling element 72.

Tubular coupling element 72 presents a compressible O-ring sealing gasket formation 73 to the region surrounding an opening in the vessel wall 74 and is provided with an internal screw thread to receive the external screw thread of a tubular connector 75, as indicated at 76.

Tubular connector 76 is in turn provided with a threaded locking nut 77 which draws gasket 73 into sealing engagement with the vessel wall 74 to establish a fluid tight seal for the outlet port 78.

Tubular connector 77 is adapted to communicate with a tubular extension piece 79 sleeved over its downstream end to bear against a spring steel C-shaped washer 80 seated within an outer annular groove 81.

Tubular connector 77 is also provided with an O-ring sealing gasket formation 83 to establish a liquid tight connection with tubular extension piece 79.

Tubular extension piece 79 at the downstream end is sleeved over the tubular inlet section 85 of a solenoid operated diaphragm valve 86, tubular inlet section 85 having an O-ring sealing gasket formation 87 to establish a liquid type connection with the downstream end of tubular extension piece 79.

If additional heat is necessary it can be supplied by an electrical resistance element 175 mounted to extend axially by a wrapping in contact with a wrapping over tubular extension piece 79 and connected to a suitably powered electrical circuit for energization.

Diaphragm valve 86 is spring loaded as indicated at 88 to urge the diaphragm 89 against the valve seat 90 presented by outlet tubular section 91 thereof.

Upon energization of the solenoid through appropriate electrical circuitry connected to a source of power, diaphragm 89 is withdrawn from the valve seat 90 whereby the diluent is passed therethrough.

A diaphragm type valve has been selected because diaphragm 89 can be easily removed for inspection or replacement and further with such arrangement the working parts of the valve are isolated from the liquid system thereby preventing contamination as well as minimizing deterioration by corrosion.

Outlet tubular section 91 leads vertically upwardly into registration within a depending tubular piece 93 of a T-shaped tubular connector indicated generally at 94 having a transverse tubular portion 95 extending substantially horizontally.

The upper end of the outlet tubular section 91 is provided with two spaced peripheral grooves 96 and 97, with the lower groove 96 being adapted to register with a corresponding groove 98 located in the inner wall of depending tubular piece 93, which in turn communicates with spaced sockets 99 and 100 which are adapted to receive the spaced ends 101, 102 of the U-shaped anchor pin 103 to releasibly lock depending tubular piece 93 and tubular extension piece 91 against separation.

The upper groove 97 is adapted to receive an O-ring sealing gasket 104 to establish a liquid tight connection.

The downstream end of tubular portion 95 of T-shaped connector 94 registers with an opening 105 in a mounting plate 106 from which the major components of the conduit system 112 are to be supported.

Tubular portion 95 is provided with an internal female thread 107 to receive the male threaded section 108 of the upstream end of a tubular section 109, the latter carrying a locking nut 110 threadibly engaged with the male threaded section 108 to clamp T-shaped connector 94, metal plate 106 and tubular section 109 together.

The downstream end of tubular section 109 is tapered externally as at 110 for registration within the correspondingly tapered inlet 111 of the upstream tubular portion 112 presented by dispensing faucet 14.

A liquid tight seal therebetween is established by a flanged nut 113 bearing against a spring steel C-shaped metal washer **114*a* lodged in an outer peripheral groove 114*b* of tubular section 109 with the flanged nut 113 threadibly engaging external thread 115 of the faucet tubular portion 112**.

Faucet 14 includes a valving chamber 116, a piston including a stem 117 and a piston head 118 reciprocably mounted within the valving chamber 116 and a plug 119 carried by the piston head for registration with the valve seat 120.

Valve stem 117 is reciprocated by a swingable handle formation 121 through a connecting pivot pin 122 extending through and carried by a pair of spaced flanges **123*a* and 123*b* presented by handle formation 121 to receive and house the upper end of valve stem 117**.

Edges **125*a*, 125*b* of flanges 123*a*, 123 *b* are rounded to aid in the swinging action of handle formation 121 when it is depressed to raise valve stem 117 to open faucet 14**.

Valve stem 117 is biased downwardly by a spring formation 126 located to bear between the upper wall of valve chamber 116 and the piston head 118 whereby the plug 119 is urged at all times against the valve seat 120 and associated handle formation 121 is at all times urged into the upright position resisting the forward movement.

Transverse tubular portion 95 of T-shaped connector 94 is provided with a reduced cross section 127 within which a smaller tubular section 128 is registered to extend centrally thereof downstream and terminating within tubular section 109 and spaced therefrom to define a surrounding liquid passageway 129 therebetween.

Tubular portion 95 presents a tubular extension 130 upstream of the reduced cross section 127 to receive therewithin the tubular outlet 131 of a solenoid operated diaphragm valve 132.

Diaphragm 133 of diaphragm valve 132 is urged against valve seat 134 bu a spring formation 135 and is opened by upon energization of the associated solenoid when power is supplied to a suitable electrical circuit.

Sleeved over upstream inlet tubular portion 136 of diaphragm valve 132 is a tubular extension piece 137, an O-ring seating gasket formation 138 being provided to establish a liquid type connection.

In addition a releasable clamp may be supplied to hold the tubular connector 137 and inlet tubular section 136 against separation.

Tubular piece 137 extends angularly upwardly through an aperture 139 located in the side wall 24 of compartment 20 to present the open end 140 thereof to sleeve onto the open end of tube 63 to establish communication between the liquid concentrate stored in sack 62 and the liquid conduit system 12.

Downstream the smaller conduit section 128 is fitted with a cap formation 141 of selected O.D. closing the open end, with cap formation 141 presenting a thin blade of fin formation 142 extending axially therebeyond downstream to register with an upper slot formation **142*a* and lower slot formation 142*b* thereby to securely fix the position of the cap formation 141 within the surrounding conduit formation and to support the smaller conduit section 128** centrally therewithin.

In the preferred embodiment cap formation 141 is provided with an orifice 144 in communication with its internal bore 143 and the bore of smaller conduit section 128 through a corresponding orifice 145 whereby the liquid concentrate may be discharged into the surrounding passageway 129.

In the preferred embodiment orifice 144 is located uppermost to define a flow path for the liquid concentrate extending substantially vertically upwardly and intersecting with the flow path defined by the surrounding passageway 129 in the plane of the blade or fin formation 142.

A substitute cap formation 141 can be installed wherein the selected OD of the orifice 144 can be greater or lesser thereby providing an arbitrary setting to vary the volume of liquid concentrate or the diluent to be delivered to the confluence or mixing station 13 as taste would dictate in the case of a beverage.

FIGS. 8 to 11 inclusive disclose a modified cap formation 241 which includes a corresponding fin formation 242, an internal bore 243 and an orifice 244 to meter the flow of liquid concentrate.

In contrast however cap formation 241 is provided with a part annular collar 245 upstanding from the outer surface 246 whereby fluid flow in surrounding passageway 129 is impeded in the region immediately upstream of orifice 244 which impedence and greater turbulence generated thereby in such region provides further control over the ultimate composition and characteristics of the two component liquid system to be dispensed.

The circumferential extent of the collar 246 preferably lies within the range of about 105° to 210°, although modified flow rates may be achieved by further limiting or extending collar 246.

The cap formation 341 illustrated in FIG. 12, and shown in vertical cross-section only, includes a fin formation 342 and an initial bore 343 terminating in a downstream discharge orifice 344 with an aperture 345 extending centrally through the body of fin formation 342 to thereby deliver liquid concentrate directly into the surrounding passageway 129 in the region of the confluence or mixing station 13.

The embodiment of FIG. 12 is especially adapted for drawing large quantities of mixed liquids from the unit over an extended time period.

In that the volume of the liquid delivered per unit time are dependent upon the cross-sectional areas of the respective slow passage conduit sections of piping will be selected as will, in combination with other factors mentioned, provide the desired proportions of diluent to solute.

The Control System

Mounted to extend through and be supported with an aperture 147 located in the mounting plate 106 is a cam 148 in the form of a rod, pivotly connected to handle formation 121 for swinging movement by a pivot pin 149 extending between the flanges 123*a* and 123*b* thereof.

Figure 4:
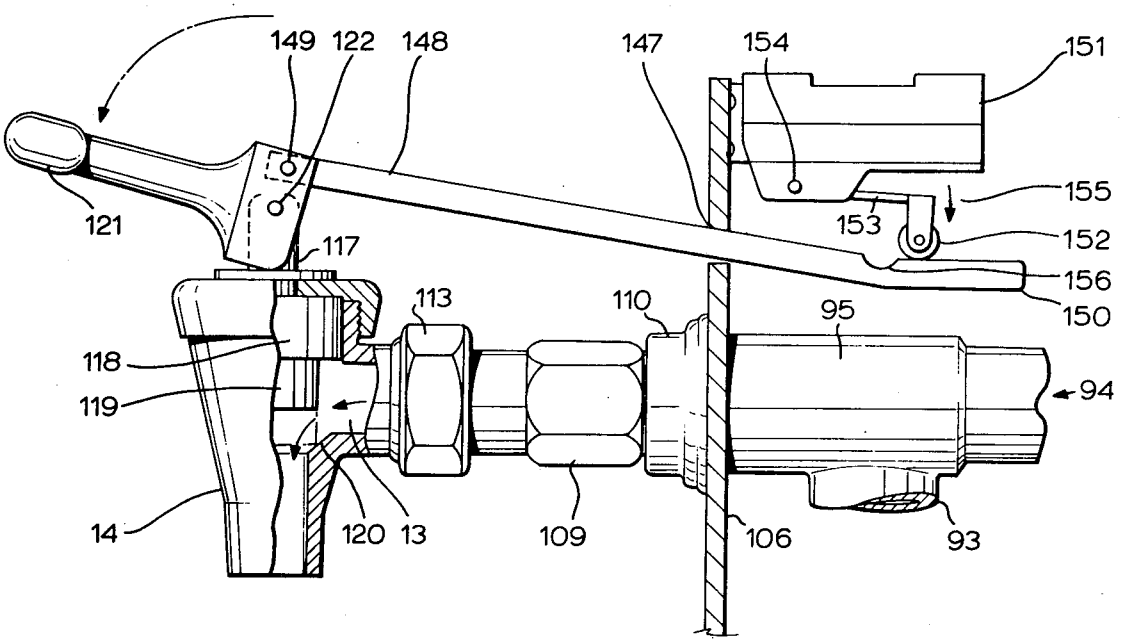
FIG. 4 is an enlarged view of the dispensing faucet and associated structure of FIG. 3, in which the valve thereof is shown in its fully open position as compared with FIG. 3 which the valve thereof is shown in the fully closed position.

When handle formation 121 is swung forwardly downwardly against the action of spring formation 126, from the position illustrated in FIG. 3 to limit position illustrated in FIG. 4 to elevate valve stem 117 and to thereby raise plug 119 from the valve seat 120 to dispense liquid, the outer pivoted end of cam 148 is displaced in a direction upwardly and outwardly and the opposite end 150 to cam 148 displaced downwardly and forwardly.

Secured to the mounting plate 106 above aperture 147 is a switch 151 operable to connect the circuit for energizing the solenoid operated valves 86 and 132 to a source of power and then to so disconnect it.

A cam follower 152 is carried by a depending switchin arm 153 for making and breaking the contact of switch 152 which arm and cam follower are biased by a suitable spring 154 in the direction of the arrow 155, whereby in such position the contact is make to connect the circuit to a source of power to energize the solenoids of valves 86 and 132 respectively to open them to pass the diluent and solute respectively.

Cam follower 152 is located such that it at all times bears against the upper surface of the rearward portion 150 of cam 148 and therefore its position is determined by that element.

It will be seen with the valve plug 119 of faucet 14 registering with valve seat 120 the swingable handle formation 121 extends vertically as illustrated in FIG. 3, in which position cam follower 152 is elevated holding arm 153 of the switch against making the contact for energizing the circuits of the solenoids of valves 86 and 132 and therefore those valves are automatically closed by springs 88 and 135 as earlier described.

In accordance with the preferred embodiment, before valves 86 and 132 are opended plug 119 of faucet 14 is to be raised well above valve seat 120 to a position wherein the obstruction to fluid flow presented by plug 119 and its associated parts is minimal, that is to a position wherein the cross sectional area of the discharge passage equals or exceeds that necessary to pass the combined flow of diluent and solute.

It is also desirable to close the solenoid operated valves 86 and 132 before the plug 119 of faucet 14 registers with the valve seat 120 in order that any liquid delivered to the mixing station can be withdrawn.

With such an arrangement a dripping faucet is avoided and further the liquid components to be mixed together and held upstream of the mixing station can be maintained substantially separate within their respective conduit sections 109 and 128.

It is to be noted that orifice 144 preferably is located uppermost in relation to conduit 128 whereby the tendency of the more concentrated solute to migrate is minimized or even eliminated if the level of the diluent in the surrounding passageway 129 falls below the level of orifice 144 under the draining action.

The desired time lag between the opening of the faucet 14 and valves 86 and 132 is accomplished by providing a recess 154 in the upper surface of cam 148 with which the cam follower 152 registers as seen in FIG. 3 so that in the inoperative position the switch arm 153 is secure.

As handle formation 121 is swung from the position in FIG. 3 towards that illustrated in FIG. 4 the biased cam follower 152 descends under the downward and forward movement of the rearward portion 150 of cam 148 until the arm 153 makes the contact to supply power to the circuits energizing solenoid operated valves 86 and 132 to open them.

The return of the handle formation 121 under the action of the spring formation 126 elevates cam follower 152 to a point where the arm formation 153 breaks the contact to disconnect the solenoid operated valves 86 and 132 respectively from a source of power and thereby close the valves before plus 119 is seated with cam follower 152 registered within the recess 154 as mentioned previously.

THE SUPPORTING FRAMEWORK

Mounting plate 106 is reinforced by a peripheral metal frame 158, the bottom section 159 thereof extending further rearwardly therebeyond to present spaced apertures therein in order that the plate 106 can be bolted as at 160 to the base frame 161.

With the arrangement illustrated the mounting plate 106 upon removal from the enclosure will carry with it all those components of conduit system 12 as are anchored to the mounting plate 106 by breaking the sleeved connections between the solenoid operated valves 86 and 132 respectively and associated tubular extension pieces 79 and 137.

Thus the conduit system 12 is made readily available for inspection or for the replacement of parts or for cleaning or scouring without the aid of any special skills.

A metal mounting plate 162, similar to plate 106 is installed in the apparatus next adjacent the conduit system 12 to support a faucet 163 to faucet 14 which is in turn connected by a conduit 164 directly to vessel 15 for the dispensing of hot water only on demand.

A control panel 165 is carried by the framework of the apparatus above mounting plates 106 and 162 to support switches for the energizing of the electrical circuits and for displaying other visual aids relating to the stages of operation.

The front panel 32 of the enclosure 29 is apertured as at 166, 167 and 168 respectively to expose faucets 14 and 163 and the control panel 165 respectively.

OPERATION

In accordance with the invention the apparatus in FIG. 1 is placed in operation by first connecting the principal electric circuits to a power supply through a main switch 170 to energize those resistance elements necessary to heat water delivered to vessel 15 to within the range between 206° F and boiling, and to drive motor driven compressor 36 to cool compartment 20 to the desired range of between 33° F and 38° F both of which are adapted to be controlled by their respective thermostatic switches.

In addition power is made available to those circuits controlling the solenoid operated inlet valve 19*a* and the level controller 19*b*.

A loaded carton 60 is deposited upon platform 54 in compartment 20 thereby compressing the supporting resilient spring formation 49 to establish the original liquid level 65.

Depending plastic tube 63 suitably clamped is sleeved over the upper end 104 of tubular connector 137 and then unclamped.

As soon as water in vessel 15 has been heated to within the optimum range of temperatures above 206° F and below boiling the apparatus if ready for use.

By depressing handle formation 121 forwardly against the action of spring formation 126 plug 119 of faucet 14 is raised out of contact with the valve seat 120.

The swinging movement of handle formation 121 displaces the cam 148 forwardly and upwardly as earlier described and as soon as the plug 119 is elevated sufficiently to substantially clear the discharge passage within faucet 14 cam 148 releases cam follower 152 from recess 153 whereupon the switching arm 153 makes contact to connect those circuits energizing solenoid operated valves 86 and 132 to a source of electrical power whereby valves 86 and 132 respectively are opened to place vessel 15 in fluid communication with larger conduit section 109 and the sack 63 containing chilled liquid coffee concentrate in fluid communication with the smaller conduit section 128.

Simultaneously the diluent and the solute descend under gravity and atmospheric pressure within their respective systems, with the diluent taking the path of the arrows 171 and the solute taking the path of the arrows 172.

As the diluent surges along the annular passageway in turbulent flow the solute is injected into the diluent in a stream extending upwardly.

The stream of diluent and solute is immediately divided by the blade or fin formation 142 and then reconstituted before it is discharged through valve seat 120 and dispensing spout 143 of faucet 14.

Upon release of the handle formation 121 spring formation 126 returns the handle formation an upright position.

In the course of that movement cam 148 is first lowered and then displaced rearwardly acting to elevate the cam follower 152 and ultimately to register the cam follower within the recess 15 to break the contact made by the switching arm 153 before the plug 119 registers with the valve seat whereby a mixture located in the region of the mixing station can escape from the faucet 14 and whereby the level of diluent in the layer conduit section 109 will be lowered below the level of the discharge orifice 144 of the smaller conduit section.

With such arrangement the proportion of solute to diluent can be accurately controlled and as earlier described the proportions varied to achieve an optimum mixture to provide a beverage of the desired character.

While the invention has been described and illustrated in relation to coffee derived from two liquid components it will be obvious that the concepts are applicable to apparatus for automatically dispensing other liquids or beverages by persons skilled in the field without departing from the spirit and the scope of the invention as defined in the following claims.

The embodiments of the invention in which an exclusive property or privilege are claimed are defined as follows:

1. In apparatus for dispensing a liquid derived from two liquid components to be delivered separately from their sources to a confluence downstream before discharge, the combination of a first larger conduit section terminating downstream in a discharge orifice and adapted for connection upstream with a first liquid source, and a second smaller conduit section supported within said first larger conduit section and in spaced relation thereto to define a surrounding passageeway therewith in the region between said discharge orifice and upstream connection of said first larger conduit section, said second smaller conduit section being adapted for connection upstream to a second liquid source and terminating downstream in an orifice defining a flow path intersecting with the flow path defined by said surrounding passageway, said second smaller conduit section including a downstream portion and an upstream portion with said downstream portion having said orifice therein and being axially slidably separable from said upstream portion, said downstream portion comprising a cap formation adapted to snugly slidably receive the downstream end of said upstream portion in conduit defining relation, and means for releasably locating and securing said axially slidably separable cap formation in fixed relation to said upstream portion and to said surrounding first larger conduit section in conduit defining relation comprising a fin formation extending radially outwardly of said cap formation and socket means presented by said surrounding first larger conduit section for snugly receiving the portion of said fin formation remote from said cap formation to anchor same therewithin against displacement.

2. Apparatus according to claim 1 wherein that portion of the first larger conduit section extending between the surrounding passageway to the discharge orifice thereof has a cross-section throughout sufficient to pass the combined liquid flow without impressing a pressure build-up.

3. Apparatus according to claim 1 wherein the flow path defined by the orifice of said second small conduit section projects substantially vertically upwardly whereby upon interruption of delivery of a liquid to said smaller conduit section, migration of the liquid is minimized.

4. Apparatus according to claim 1 wherein the flow path defined by the orifice of said second smaller conduit section projects substantially axially thereof downstream.

5. Apparatus according to claim 1 wherein the flow path defined by the orifice of said second smaller conduit section projects substantially vertically upwardly and the discharge orifice for said larger conduit section is located downstream therebeyond and therebelow whereby upon interruption of delivery of liquid to said conduit sections from their respective sources, liquid may be drained from said first larger conduit section only.

6. Apparatus according to claim 1 wherein said cap formation is provided with a part annular shoulder formation location upstream of said orifice and extending radially outwardly thereof thereby to impede fluid flow within said surrounding passageway in the region of said orifice.

7. Apparatus according to claim 6 wherein said part annular shoulder formation has a part circumferential extent of the order of between 105° to 210°.

8. Apparatus according to claim 1 wherein said fin formation is provided with an aperture located centrally thereof and said orifice of said cap formation defines a flow path extending substantially axially thereof downstream and registereing with said aperture of said fin formation.

9. Apparatus according to claim 1 wherein said first larger conduit section is provided with valve means located between the downstream orifice thereof and the downstream orifice of said second smaller conduit section supported therewithin, said valve means being operable to interrupt fluid flow therethrough.

10. Apparatus according to claim 9 wherein a valve means is provided for each of said conduit sections upstream from the orifice of said smaller conduit section, each second mentioned and third mentioned valve means being operable to interrupt the low of liquid thereto, and means responsive to the operation of said first mentioned valve means respectively whereby fluid flow in the respective regions can be controlled by operation of said first mentioned valve means.

11. Apparatus according to claim 10 wherein said first mentioned valve means is manually operable and each of said second mentioned and third mentioned valve means comprise a solenoid operated valves and said means responsive to the operation of said first mentioned manually operated valve means include switch means for connecting and disconnecting said electrical circuit means to a source of power.

12. Apparatus according to claim 11 wherein said means responsive to the operation of said first mentioned valve means include cam follower means connected to said switch means and a cam connected to said manually operated valve means for displacement under the action of said valve in moving from the closed position to the open position and reversely said cam and cam follower means having a confined path of travel such that displacement by said switch means to connect said electrical circuit means to a source of power and displacement in the opposite direction actuates said switch means to disconnect said electrical circuit means from a source of power and means urging said cam follower means into engagement with said displaceable cam.

13. Apparatus according to claim 12 wherein said displaceable cam and said cam follower means have a configuration such that said switch means is actuated to connect said electrical circuit means to a power source after said first mentioned valve means has been moved out of the closed position towards the opened position and said switch means is actuated to disconnect said electrical circuit means from a power source after said first mentioned valve means is moved out of the opened position towards the closed position.

14. In apparatus for dispensing a liquid derived from two liquid components to be delivered separately from their sources to a confluence downstream for discharge, the combination of a first larger conduit section terminating downstream in a discharge orifice and adapted for connection upstream with a first liquid source and a second smaller conduit section supported within said first conduit section and in spaced relation thereto to define a surrounding passageway therewith in the region between said discharge orifice and the upstream connection of said first larger conduit section, said second smaller conduit section being adapted for connection upstream to a second liquid source and terminating downstream in an orifice defining a flow path intersecting with the flow path defined by said surrounding passageway manually operable valve means located in that portion of said first larger conduit section extending between said surrounding passageway and the discharge orifice thereof and operable therein for interrupting fluid flow therethrough and valve means for each of said conduit sections located upstream of said orifice of said smaller conduit section, each operable to interrupt the flow of liquid therethrough, each said latter valve means comprising a solenoid operated valve and including electrical circuit means for powering same and means responsive to the operation of said first mentioned manually operated valve means, including switch means, for connecting and disconnecting said electrical circuit means to a power source, whereby fluid flow in the respective regions is adapted to be controlled by the manual operation of said first mentioned valve means.

15. Apparatus according to claim 14 wherein said means responsive to the operation of said first mentioned valve means include cam follower means connected to said switch means and a cam connected to said manually operated valve means for displacement under the action of said valve in moving from the closed position to the open position and reversely said cam and cam follower means have a confined path of travel such that displacement by said manually operated valve means in one direction actuates said switch means to connect said electrical circuit means to a source of power and displacement in the opposite direction actuates said switch means to disconnect said electrical circuit means from a source of power and means urging said cam follower means into engagement with said displaceable cam.

16. Apparatus according to claim 15 wherein said displaceable cam and said cam follower means have a configuration such that said switch means is actuated to connect said electrical circuit means to a power source after said first mentioned valve means has been moved out of the closed position towards the opened position and said switch means is actuated to disconnect said electrical circuit means from a power source after said first mentioned valve means is moved out of the opened position towards the closed position.

* * * * *